United States Patent [19]

Charters

[11] Patent Number: 4,515,601

[45] Date of Patent: May 7, 1985

[54] CARBONACEOUS BRIQUETTE

[76] Inventor: John E. Charters, 61 W. Delta Green, Port Hueneme, Calif. 93041

[21] Appl. No.: 373,878

[22] Filed: May 3, 1982

[51] Int. Cl.[3] ..... C10L 5/12; C10L 5/14

[52] U.S. Cl. ..... 44/19; 44/10 L; 44/10 C

[58] Field of Search ..... 44/16 R, 1 F, 16 C, 44/19, 23, 10 C, 10 L

[56] References Cited

U.S. PATENT DOCUMENTS

| | | | |
|---|---|---|---|
| 2,834,660 | 5/1958 | Eisenhut et al. | 44/19 |
| 3,403,989 | 10/1968 | Blake et al. | 44/23 |
| 4,152,119 | 5/1979 | Schulz | 44/1 D |
| 4,230,460 | 10/1980 | Maust, Jr. | 44/16 C |
| 4,272,324 | 6/1981 | Sunami et al. | 44/1 F |

*Primary Examiner*—Carl F. Dees

*Attorney, Agent, or Firm*—Carl D. Farnsworth

[57] ABSTRACT

Green briquette agglomerates (10) are manufactured by simultaneously crushing and blending high sulfur petroleum coke (20), a high R/B softening point, high sulfur and metals content asphaltene binder (22), and dolomitic limestone (24) as a sulfur sorbent in pulverizer (26). The uniform mixture is cold pressed on roll briquetting machine (85) into durable briquettes (104). On gasification or combustion, a high percentage of the sulfur combines with the Dolomite and is discharged from the gasifier or furnace with the ash. The sorbent effectiveness and degree of sulfur oxide emission control are significantly enhanced versus prior art when burning a high sulfur coke in the improved briquette of the invention.

11 Claims, 4 Drawing Figures

CARBONACEOUS BRIQUETTE

DESCRIPTION

1. Technical Field

The present invention relates to a solid fuel and, more particularly, to a high-sulfur content briquette which, upon combustion, emits very low amounts of sulfur oxides into the atmosphere.

2. Background Art

Anthracite coal is a principal source of metallurgical coke, and is a preferred domestic and commercial solid fuel due to its consistent size and hardness of lumps, very high carbon content, high heating value, low volatility, low ash, and especially low sulfur content. The value of anthracite as a fuel is particularly enhanced by its uncontrolled low sulfur stack gas emission. Anthracite is the solid fuel of choice in the United States, and, more often, in the Far East, for certain space heating, cooking, stoker boiler, and metallurgical uses. Anthracite in lump size is the solid fuel of choice even though it is relatively expensive and deposits are found in limited geographical areas. High rank, low sulfur bituminous coal is often substituted for anthracite in stoker and metallurgical uses.

Anthracite production in the United States in 1981 was about 6 million tons, principally in Pennsylvania and Kentucky. Although additional anthracite deposits may be found and developed in other countries and additional United States production is possible at higher cost, adequate supplies are not expected to be developed to meet the increasing world demand. Demand is driving up the cost of anthracite in localities such as New England, where it is depended upon as a residential or commercial fuel, and in the Great Lakes states where it is a premium raw material for metallurgical quality coking coal.

One country in the Far East (South Korea) purchased 3.5 million tons of U.S. anthracite fines in 1981 at a cost of about $70 per metric ton delivered. The waste fines were then briquetted by conventional means and utilized as a residential or commercial fuel for space heating and cooking. Fines were to meet the following specifications:

| | |
|---|---|
| Moisture | 7% max |
| BTU/lb | 9,900 min |
| Ash | 30% max |
| Sulfur | 1.0% max |
| Volatile matter | 10% max |
| Size | 25 mm max |

Another solid carbonaceous material having low volatility and low sulfur emission is low sulfur calcinable electrode grade petroleum coke. However, the cost of this high quality petroleum coke is at least fifty (50%) percent more than that of anthracite on a BTU basis. More than eleven (11) million tons of electrode grade petroleum coke was produced in the United States in 1980. A growing volume of lower cost petroleum coke, however, is available (six [6] million tons in 1980).

It has been well reported that petroleum coke is commonly available for use as a solid fuel. Although it is produced and handled by large traders in most areas of the United States, domestic fuel-grade use is expected to grow from a 1980 level of 700,000 tons to only about three (3) million tons in 1985. Domestic production of fuel-grade petroleum coke (i.e. sulfur and metals contents above specifications for anode grade) should exceed eight (8) million tons per year by 1985, as refiners process heavier crudes containing higher sulfur and metals contents. The constraints to fuel-grade petroleum coke utilization include cost of sulfur oxide emission control, low volatile content (difficult to ignite), and high metals content (as a pulverized fuel, vanadium must be passivated with expensive additives to prevent corrosion of boiler tubes).

Most fuel-grade petroleum coke is blended by large traders to a maximum sulfur content of three (3%) percent and the blend is exported to Europe or the Far East where it is sold for about eighty-five (85%) percent of the price of steam coal, which is usually lower in sulfur content and heating value.

The uses for fuel-grade petroleum coke include fuel for cement kilns and mixing with steam coal for electric utility use. Although solid fuel conversions (from higher cost natural gas or heavy fuel oil) will provide a growing market for fuel-grade petroleum coke, the incentive to find a fuel-grade petroleum coke desulfurization process will increase due to environmental costs and the resultant premium placed on low sulfur fuels.

Sulfur in petroleum is mostly present in the form of C-S bonds, a very stable and difficult bond to break. To clean up gas oil and lighter refinery streams, it is common practice to utilize hydrodesulfurization at 1,000 to 3,000 PSIG. Hydrodesulfurization of heavy lube oils and atmospheric distillation residues is practiced at even higher temperatures and pressures, and consumes large quantities of expensive catalysts and hydrogen. This process would be impractical to practice with the heavier, high sulfur vacuum residuum products. Because of economics, it has been common practice to feed distillation residues to cokers, and sell the high sulfur coke as fuel at twenty to thirty ($20 to $30) dollars per ton. Post-combustion stack gas treatment with sulfur oxide sorbents, such as calcium oxide typically removes fifty (50%) percent and adds an equivalent cost of approximately seventy-five ($0.75) cents per million BTU, which would be approximately twenty three ($23) dollars per ton of coke.

Currently, some refiners are recovering an oil and resin extract from the asphalt (vacuum residuum) fraction of crude for further upgrading. One such extraction process, known as deep solvent deasphalting (DSDA), utilizes butane or pentane instead of propane as the extraction solvent: The pitch or asphaltene residue from processing of sour crude by DSDA, having a Ring and Ball (R/B) softening point of 100° F. to 350° F., has a shrinking market in asphalt and fuel oil, and is not presently acceptable as an on-site fuel due to the high sulfur content (two [2%] to ten [10%] percent), corrosive contained vanadium (500 to 2,000 parts per million) and high viscosity (up to 8,000 cs at 450° F.) at normal burner temperature. It also cannot be readily utilized in a slurried oil or water suspension, nor with coal or coke in the form of chips or flakes, due to its tendency to soften and adhere to the pulverizer or to grates in a stoker furnace.

The asphaltene residue from DSDA may be blended with higher value cutter stocks to form a coker feedstock or a material marketed as No. 6 fuel oil or as a petroleum asphalt. Coke quality would be degraded by adding back the contaminated residue. The markets for asphalt and No. 6 fuel oil are expected to decline significantly in the next decade while asphaltene supply will be growing. Refiners would prefer to utilize DSDA and dispose of the excess asphaltenes while further upgrading the higher valued oils, resins, and cutter oil stocks, but no alternative commercial-scale uses have been found for the solvent extracted asphaltene fraction.

The forthcoming deregulation of the price of natural gas in the United States by the end of 1985, and recent deregulation of oil prices, is also creating an increased domestic demand for anthracite and steam-grade coal. Homes in New England are converting from oil burners to modern coal or wood-burning furnaces. Though anthracite is preferred, supplies in the winter of 1980–1983 were exhausted by January, 1980. Many solid carbonaceous fuels can be economically converted to medium or low BTU synthetic fuel gases. The preferred fuels for combustion or gas production are lump low sulfur anthracite or high rank bituminous coals which are best adapted to be fed to the grates of stoker-fed furnaces or utilized in vertical, upward draft stoves and gasifiers. Small residential, commercial, and industrial users are not well equipped to operate gas-cleaning equipment. Therefore, there is a need for an economical, clean-burning solid fuel. With assurance of an adequate supply of such a fuel, many small domestic and foreign users of gas and oil would switch to coal-burning (or solid fuel-fired) furnaces or synthetic gas producers.

Naturally-occurring clean-burning solid fuels have limited availability in most parts of the world, including New England and the Far East (two critical areas where shortages of anthracite exist). Clean solid fuels such as wood, charcoal, and anthracite are depended upon for primary space and water heating in many homes and businesses, and, also for cooking in the Far East. In the United States, the wood products industry utilizes wood waste for steam-electric generation on a large scale (up to $5\times10^{12}$ BTU per year at a typical pulp mill). The increasing cost and short supply of such fuels, however, has recently provided incentives to develop a high quality substitute solid fuel, suitable for stoves, stokers, and gas producers.

Molten soft asphalts, pitches and bitumens have previously been utilized to coat particles of coke, char, coal, or lignite prior to pelleting, extruding, or roll briquetting. These processes require application of substantial heat to the mixture (typically 200° to 500° F.) with kneading in order to obtain intimate mixing as described in U.S. Pat. No. 4,272,324 to Sunamis and U.S. Pat. Nos. 4,192,652 and 4,226,601 to Smith. Blake (U.S. Pat. No. 3,403,989) discloses a carbonaceous briquette containing 10 to 25 percent by weight of a binder which is an asphalt having a softening point from 100° F. to 225° F. that is ninety (90%) percent soluble in benzene in order to improve mechanical properties.

Briquettes of questionable mechanical durability and weather resistance may also be formed of sulfur-containing coal, an inorganic binder, and a sulfur sorbent such as Ban (U.S. Pat. No. 4,259,085) and the Smith patents discussed above. Sorbents have been mixed with coal and lignite in finely divided form, pelletized or briquetted with starch, latex, or cement binders, cured and combusted or gasified (Battgue-Columbus Art). The literature notes use of lime and limestone sorbents, and notes that barium, sodium, potassium and dolomite bases could be used. There is no evidence in the prior art that dolomite or nahcolite have actually been employed in a premixed pelletized or briquetted fuel as a sulfur oxide sorbent.

Ban teaches that calcium carbonate ($CaCo_3$) in pelletized coal will retain less than 50% of the sulfur in the ash. Calcined lime, which is normally ten times the cost of limestone or dolomite, was shown by Smith (U.S. Pat. No. 4,226,601) to retain 81.3% at a reasonable stoichoimetric ratio (SR) of 1.23 calcium to sulfur (Ca:S) in a coal/lime powder subjected to combustion. Limestone retained 57%. Smith also submitted only comparative results from actual stove combustion tests on one and one-quarter ($1\frac{1}{4}$") inch diameter pellets, so absolute percentage retention is not revealed. However, Battelle-Columbus pellets of this description, at a SR of 4, captured about fifty (50%) percent sulfur from coal, and produced an objectionable amount of fines in a stoker test.

Lignite and bituminous coal contain much higher volatile matter than coke, and are softer than coke, containing fractions behaving like a binder when mixed or pressed. Such coals also contain about five (5%) to twenty (20%) percent ash content, while coke contains only about one (1%) percent ash. The technically successful coke or char briquetting processes discussed above require costly devolatilization or heat curing, in addition to hot mixing, and utilize soft pitch or asphalt which contain valuable oils and resins, in order to form mechanically stable products. The low cost, high sulfur fuel grade petroleum coke has not heretofore been commercially briquetted because of the poor quality of briquettes, the economics of briquetting, the low value of solid fuels of high sulfur content, and the unavailability of a suitable high softening point asphaltene solid binder.

DISCLOSURE OF INVENTION

In the present invention, low cost petroleum refining by-product and waste materials (residues) are combined in a direct way to produce a mechnically stable, clean-burning briquetted fuel product. In the process of the invention, high sulfur petroleum coke (2 to 10 percent by weight sulfur) is comminuted and dry blended with a solid hydrocarbon binder, preferably an asphaltene product of DSDA also containing a high level of sulfur, and an inorganic scavenger such as a finely divided alkali or alkaline earth metal oxide or carbonate, preferably a readily available low cost mineral such as fine dolomitic limestone. The intimately mixed dry material is then pressed without external heating into hard, mechanically stable briquettes.

On combustion or gasification, the carbon content of the briquettes will be oxidized to carbon oxide gases or reacted with water to form carbon oxides and methane. The sulfur will be oxidized to sulfate ($SO_4$=) or reduced to hydrosulfide (HS—), which will further combine with the alkali and/or alkaline earth metal cations to form salts which remain behind in the furnace or reactor as ash or will be emitted with the flue gas. The process of the invention results in retention of at least seventy (70%) percent by weight of the sulfur as ash, which has been observed to form coarse grains not easily airborne. The invention permits economic commercial and industrial utilization of low cost petroleum residues in conventional stoker or fixed grate furnaces and gas producers while maintaining sulfur oxide and particulate stock gas emissions within acceptable limits. The briquette fuel of the invention can be utilized as a synthetic anthracite for cooking in homes, since the low amount of sulfur oxide emissions will not be offensive to humans, nor will it add an offensive flavor to food cooked on a briquette-fueled stove.

The briquettes of the invention can be formed from dry, cold mixed ingredients by pressing into numerous shapes such as flakes, rods, spheres, squares, etc. A preferred shape is a convex pillow shape such as some charcoal briquettes. The preferred briquette dimension for a grate or stoker furnace is from ⅜ inch to 3 inches in size, the larger being suitable for home use. The briquettes have excellent compressive strength even in the pressed, green, unfired, uncured state. They also have excellent tumble resistance and do not flake, chip, or expell dust in normal handling. Green compressive strength is from 200 to 700 psi depending on the amount and softening temperature of the binder. The binder is present in a low amount of from five (5%) to twenty (20%) percent by weight. About 10 weight percent of higher penetration (R/B softening point of 300° to 400° F.) binders are preferred since they are not as tacky and are easier to process. Best results are obtained when all surface moisture is removed, and total moisture content of the mix is below about five (5%) percent. The product is highly weather resistant, absorbing less than four (4%) percent moisture after immersion for ninety (90) hours.

The synthetic anthracite of the invention is easily transported and handled by the loading, unloading, and transportation equipment utilized for coal, coke or charcoal. The briquette of the invention is formed of a low mineral content coke and binder which produce a minimum amount of ash in comparison to coal or lignite. The only substantial source of ash is from the reaction products of the sorbent with sulfur and nitrous oxides or hydrosulfides. The sorbent can be a mixture of very low cost, readily available minerals designed to provide optimum ash properties, sorbent action, and cost. The invention also relates to optimization of the process by grinding the materials to preferred sizes before pressing into a briquette.

These and many other features and attendant advantages of this invention will become apparent as the invention becomes better understood by reference to the following detailed description when considered in conjunction with the accompanying drawings.

DETAILED DESCRIPTION OF THE INVENTION

Figure 1:
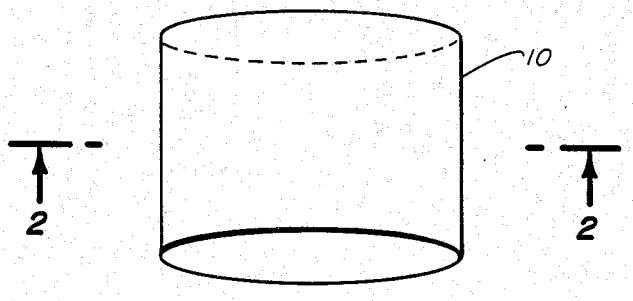
FIG. 1 is a perspective view of a pillow-shaped briquette.
Figure 2:
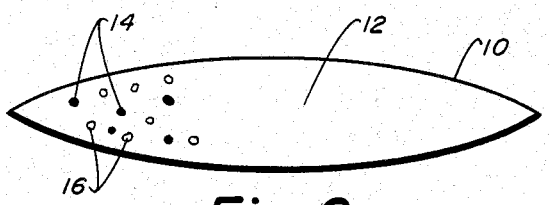
FIG. 2 is a view in section taken along line 2—2 of FIG. 1.

Referring now to FIGS. 1 and 2, the briquette 10 of the invention can be any common shape. A preferred shape that can be mass produced by roll-pressing is a pillow-shape. The briquette contains a binder phase 12 and dispersed particles 14 of coke and dispersed particles 16 of inorganic sulfur sorbent. The major component of the briquette is coke, which is present in an amount of from fifty (50%) to eighty (80%) percent by weight. The binder is present in an amount from five (5%) to twenty (20%) percent by weight and the inorganic sulfur sorbent is present in an amount from ten (10%) to thirty (30%) percent by weight.

The fuel grade petroleum coke can be derived from any petroleum coking process (e.g. Fluid, Delayed, Thermal, etc.) and can have any sulfur level above about two (2%) percent. However, for most commercial applications, fuel grade petroleum coke will contain from two (2%) to ten (10%) percent by weight of sulfur, more than 250 parts per million (ppm) metals, and will be derived from petroleum refining cracker and vacuum bottoms. Green coke directly from the coking drums is normally stored for rail or barge shipment, or calcined on site if suitable in quality for electrode manufacture. This invention will utilize the lowest quality green coke, dried to less than five (5) weight percent moisture.

The binder is preferably a hydrocarbon material having a significant fuel value, and can be pitch, tar, or asphaltene derived from petroleum, coal, lignite, tar sands, bitumen, or wood pyrolysis processing. It is usually a DSDA asphaltene, but a pitch, bitumen or asphalt may be used. The preferred binder for use in the dry-blending, green compression briquette forming process of the invention is an asphaltene having an R/B softening point above 200° F. and below 400° F., generally from 220° F. to 350° F., and having a sulfur content from two (2%) to eight (8%) percent by weight. Though distillation and extraction processes concentrate valuable transition metal impurities such as nickel and vanadium, a significant fraction of these impurities will also form ash in the process of the invention.

DSDA can be practiced by commercially available technology Residuum Oil Supercritical Extraction (ROSE) process offered by an independent oil company. Either a soft pitch material (R/B of 200° F. to 260° F.) or hard asphaltene material (R/B of 300° F. to 350° F.) can be derived as the residue from this process, depending upon the solvent utilized (isobutane, normal butane, or normal pentane). The asphaltene binder should contain at least thirty-five (35%) percent by weight of these pentane-in-soluble asphaltenes, usually from forty (40%) to eighty (80%) percent by weight. The atomic ratio of C:H is at least 0.8, preferably at least 0.9. Low cost materials can best be recovered from vacuum bottoms derived from 8° to 12° API sour crudes currently being imported and produced in the United States at economical prices.

The sulfur sorbent is utilized in the form of a finely divided alkali metal or alkaline earth carbonates, oxides, hydroxides, or salts, generally one hundred (100%) percent passing 20 mesh or finer prior to briquetting and preferably fine than 50 mesh. Group I and Group II alkali metal carbonates or bicarbonates are preferred. Low grade unrefined (raw) minerals can be utilized such as trona ore, which contains at least forty (40%) percent combined $Na_2CO_3$ and $NaHCO_3$, nahcolite which contains at least forty (40%) percent $NaHCO_3$ and dolomitic limestone which contains at least ninety (90%) percent $CaMg(CO_3)_2$ and preferably at least forty (40%) percent of which is $MgCO_3$. The preferred level of sulfur sorbent to be utilized depends upon the sulfur content of the coke and binder, the permissible level of sulfur emission, the required heating value of the final fuel and the mechanical properties of the green, pressed agglomerate. Since the other ingredients provide little or no ash, the sulfur sorbent can be present in any amount determined by the criteria discussed previously.

Figure 3:
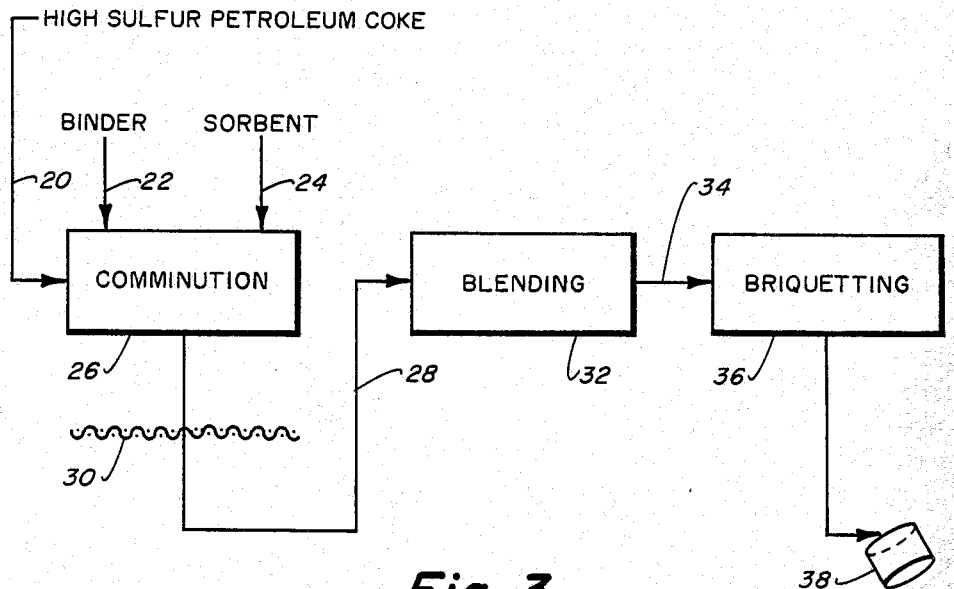
FIG. 3 is a block, diagrammatic view of a process for producing carbonaceous briquettes in accordance with the invention.

Referring now to FIG. 3, the process of the invention prepares a tumble resistant, tough briquette of selected dimensions by the steps of pulverizing the coke 20, solid binder 22 and sulfur sorbent 24 in one or more comminutors 26, passing the output 28 through screen 30 to form a −20 mesh or finer product which is delivered to a mixer 32 for blending (Items 26 and 32 may be combined). The intimately mixed mixture 34 is then cold pressed and shaped in briquetter 36 to form green, pressed briquettes 38 (extrusions or other devices may be employed). This process results in substantial savings in energy as compared to the hot mix method.

Figure 4:
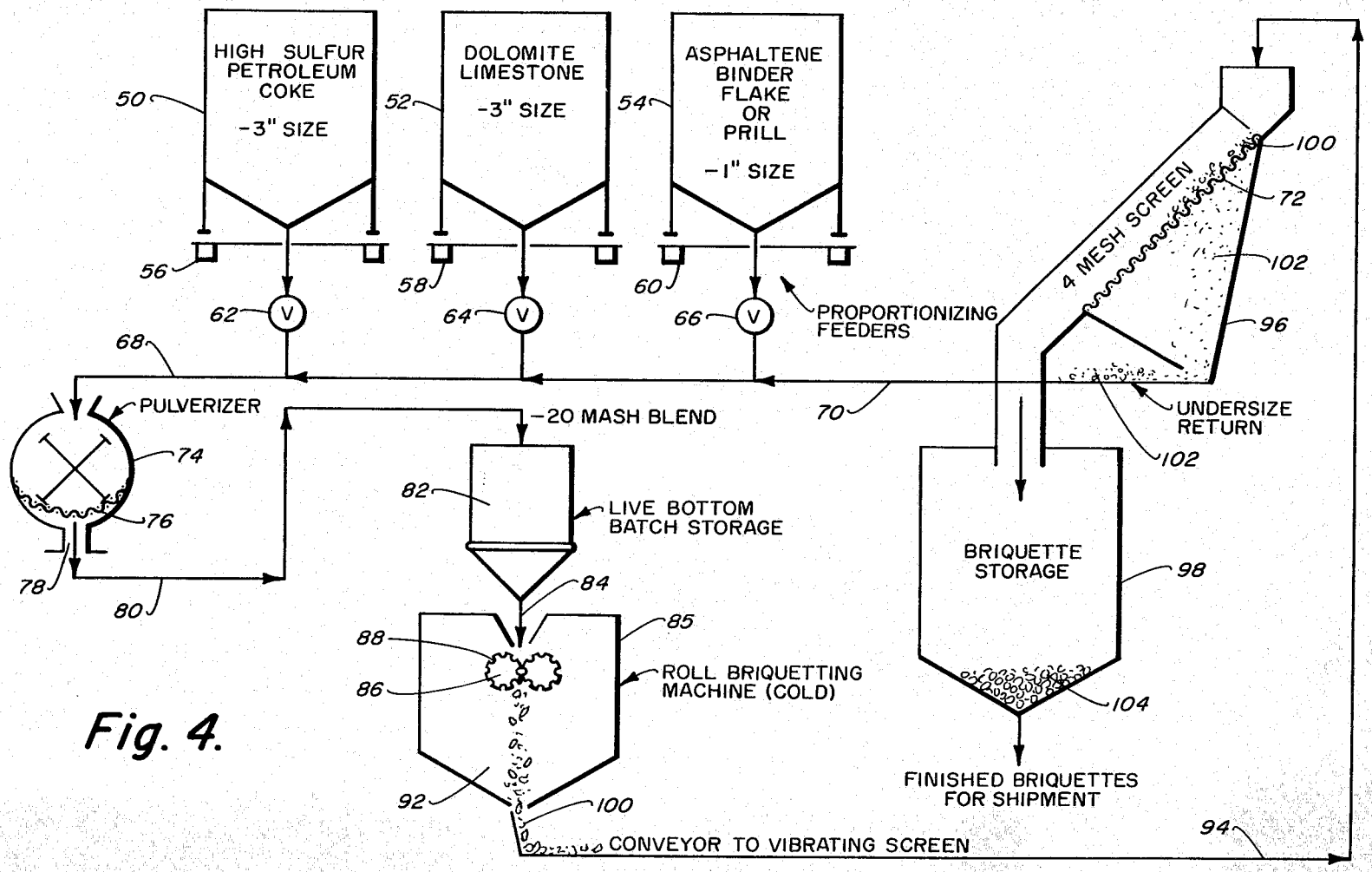
FIG. 4 is a schematic view of a briquette manufacturing process.

A more detailed process is depicted in FIG. 4. Storage hoppers 50, 52, and 54, mounted on scales 56, 58, and 60, are fed dry high sulfur coke and dolomitic limestone (generally from ¼ to 5 inches in size, usually minus 3 inches), and asphaltene binder flakes (minus 1 inch) from bulk storage, not shown. Each hopper is connected by means of proportioning feeder valves 62, 64, and 66 to conveyor 68. Conveyor 68 is also connected to Conveyor 70 carrying undersize return from vibrating screen 72. Conveyor 68 feeds a batch of coke, limestone and binder to the pulverizer-blender 74 when valves 62, 64, and 66 are open. The pulverizer, usually a hammer or cage mill, passes a minus 20 mesh blended product through screen 76 and outlet 78 into line 80.

The briquette blend is fed through outlet 84 into a cold roll briquetting machine 85 containing opposing rolls 86 having forming cavities 88. The briquette product 100 drops through outlet 92 onto a conveyor 94 which carries it to vibrating screen 72. The screen passes minus 4 mesh undersize material 102 into compartment 96 from which it is fed onto conveyor 70. The plus 4 mesh product 104 is fed from vibrating screen 92 into briquette storage bin 98.

EXAMPLE ONE

A first group of experiments was conducted utilizing high sulfur, green petroleum coke, sand, minus 20 mesh, dolomite, nahcolite or bentonite minerals and an asphaltene having the properties shown in Tables IA and IB.

TABLE IA

| RAW MATERIAL CHARACTERISTICS | | | | | | | |
|---|---|---|---|---|---|---|---|
| | | | Asphaltenes | | | | |
| Property | Coke A | Coke B | Soft | Hard | Limestone | Dolomite | Nahcolite |
| HHV, BTU/lb | 15,500 | 15,520 | 17,510 | 17,440 | 0 | 0 | 0 |
| Fixed Carbon, % | ND | 85.0 | 12.8 | 28.7 | 0 | 0 | 0 |
| Volatiles, % | 10.1 | 14.8 | 87.2 | 71.2 | 0 | 0 | 0 |
| $H_2O$, % | 0 | 1.9 | 0 | 0 | 0 | 0 | 1.94 |
| Ash, % | 0.17 | 0.18 | 0.1 | 0.12 | — | — | — |
| Sulfur, % | 3.21 | 3.82 | 1.75 | 2.22 | 0.03 | 0 | 0.365 |
| Vanadium, % | ND | 0.04 | 0.03 | 0.08 | 0 | 0 | ND |
| $CaCO_3$ | — | — | — | — | 90.4 | 53.2 | — |
| $MgCO_3$ | — | — | — | — | 6.3 | 45.8 | — |
| $Na_2CO_3$ | — | — | — | — | — | — | 3.38 |
| $NaHCO_3$ | — | — | — | — | — | — | 53.58 |
| R/B S.P., °F. | — | — | 220 | 315 | — | — | — |
| Sp.Gr. | — | — | 1.1 | 1.15 | — | — | — |

TABLE IB

| RAW MATERIAL CHARACTERISTICS | | | | | | | |
|---|---|---|---|---|---|---|---|
| | | | Asphaltenes | | | | |
| Property | Coke A | Coke B | Soft | Hard | Limestone | Dolomite | Nahcolite |
| Particle Size For Screening Tests: | | | | | | | |
| Cum. % on | | | | | | | |
| 20 m | 0 | 0 | 0 | 0 | 0 | 0 | 0 |

TABLE IB-continued

| RAW MATERIAL CHARACTERISTICS | | | | | | | |
|---|---|---|---|---|---|---|---|
| | | | Asphaltenes | | | | |
| Property | Coke A | Coke B | Soft | Hard | Limestone | Dolomite | Nahcolite |
| 50 m | ND | 52.8 | 38.1 | 38.6 | 19.1 | 44.9 | ND |
| 100 m | ND | 71.4 | 62.8 | 64.4 | 40.7 | 60.5 | ND |
| 200 m | ND | 82.6 | 75.8 | 76.4 | 69.7 | 72.6 | ND |
| 325 m | ND | 92.6 | 90.0 | 90.0 | 87.4 | 80.0 | ND |
| −325 m | ND | 7.4 | 10.0 | 10.0 | 12.6 | 20.0 | ND |

NOTE:
ND = No Data

Results of Screen Tests No. 1 through 12-A are summarized in Tables No. IIA and IIB and III. These preliminary evaluations were made using 1 inch diameter × 1 inch high hand-pressed pellets. Samples were burned in an open muffle furnace at 1000° F. Results illustrate the superior mechnical and sulfur retention properties of the pellets.

TABLE IIA

| SCREENING TESTS - MECHANICAL STRENGTH OF 1" HAND PRESSED PELLETS | | | | | | | |
|---|---|---|---|---|---|---|---|
| | Houndsfield Tensometer Compressing | Coke $H_2O$, | COMPONENTS, WEIGHT % | | | | |
| | | | Coke | | Asphaltenes | | |
| Mix No. | Strength PSI | % | A | B | Soft | Hard | Bentonite |
| 2 | 815 | 0 | — | — | 80 | — | — |
| 4 | 64 | 0 | 80 | — | — | — | — |
| 5 | 331 | 0 | 55 | — | 20 | — | — |
| 6 | 432 | 0 | 60 | — | 20 | — | — |
| 6-A | 477 | 0 | 55 | — | 20 | — | — |
| 7 | 0 | 0 | 75 | — | — | — | — |
| 8 | 840 | 0 | — | — | 80 | — | — |
| 9 | 331 | 0 | 60 | — | 20 | — | — |
| 9-A | 344 | 0 | 55 | — | 20 | — | — |
| 10 | 229 | 0 | 70 | — | 10 | — | 5 |
| 10-A | 101 | 6.3 | 70 | — | 10 | — | 5 |
| 11 | 407 | 0 | 60 | — | 20 | — | 5 |
| 11-A | 165 | 5.6 | 60 | — | 20 | — | 5 |
| 12 | 305 | 0 | 70 | — | 10 | — | — |
| 12-A | 274 | 0 | 65 | — | 10 | — | — |
| 21 | 253 | 1.9 | — | 70 | — | 5 | — |
| 22 | 294 | 1.9 | — | 65 | — | 10 | — |
| 22-A | 298 | 1.9 | — | 65 | — | 10 | — |
| 22-B | 310 | 1.9 | — | 65 | — | 10 | — |
| 23 | 312 | 1.9 | — | 70 | 5 | — | — |
| 24 | 411 | 1.9 | — | 65 | 10 | — | — |
| Below are Minus 50 Mesh Batches: | | | | | | | |
| 25 | 469 | 1.9 | — | 70 | 5 | — | — |
| 26 | 580 | 1.9 | — | 65 | 10 | — | — |
| 27 | 483 | 1.9 | — | 70 | — | 5 | — |
| 28 | 568 | 1.9 | — | 65 | — | 10 | — |

TABLE IIB

SCREENING TESTS - MECHANICAL STRENGTH OF 1" HAND PRESSED PELLETS

| | COMPONENTS, WEIGHT % SORBENT | | | |
|---|---|---|---|---|
| Mix No. | Silica | Limestone | Dolomite | Nahcolite |
| 2 | — | — | 20 | — |
| 4 | — | — | 20 | — |
| 5 | 25 | — | — | — |
| 6 | — | — | 20 | — |
| 6-A | — | — | 25 | — |
| 7 | — | — | — | 25 |
| 8 | — | — | — | 20 |
| 9 | — | — | — | 20 |
| 9-A | — | — | — | 25 |
| 10 | — | — | 15 | — |
| 10-A | — | — | 15 | — |
| 11 | — | — | 15 | — |
| 11-A | — | — | 15 | — |
| 12 | — | — | 20 | — |
| 12-A | — | — | 25 | — |
| 21 | — | 25 | — | — |
| 22 | — | 25 | — | — |
| 22-A | — | — | 25 | — |
| 22-B | — | 25 | — | — |
| 23 | — | 25 | — | — |
| 24 | — | 25 | — | — |
| Below are Minus 50 Mesh Batches: | | | | |
| 25 | — | — | 25 | — |
| 26 | — | — | 25 | — |
| 27 | — | — | 25 | — |
| 28 | — | — | 25 | — |

have similarly. Results with limestone at a stoichiometric ratio of between 1.5:1 and 4:1 for Ca:S should fall in the range of forty (40%) to sixty (60%) percent sulfur (S) retention, when the art of Ban and Smith are combined. None of the prior art claims imply that dolomite is preferred, yet dolomite with Ca:S ratios as low as 1.57 were clearly superior to limestone (Tests 6-A, 12-A, 22-A). It is probable that dolomite retains greater reactive pore surface area near completion of the burn, thus allowing greater Ca utilization.

Not surprisingly, the present invention extends the application of prior art to pelletized or briquetted petroleum coke with limestone, at a stoichiometric ratio of approximately 2.6 Ca:S. Upon combustion, limestone will retain approximately sixty (60%) percent of the sulfur (Tests No. 21–24). Coke from refining of sulfur containing (sour) crudes may behave differently from bituminous coal in the mechanism of sulfur (S) release and capture, since little or no pyrite is present in petroleum coke, but the superior effectiveness of dolomite and nahcolite are surprising. This invention demonstrates that an economical sorbent, dolomite, is much more effective than limestone. With ash fusion point and economic limitations, any necessary sorbent improvement up to approximately ninety (90%) percent capture can be achieved by partial to full substitution of trona or nahcolite for limestone or dolomite. This discovery allows use of higher sulfur petroleum coke (e.g. 7.5% sulfur at 15,500 BTU per pound and eighty (80%) percent sulfur retention is equivalent to 1.0% sulfur coal at 10,000 BTU per pound and no retention).

TABLE III

SCREENING TESTS - SULFUR RETENTION RESULTS ON 1" HAND PRESSED PELLETS

| | Fuel Properties | | Stoichiometric Ratio of Sorbent at 25 wt % (Ca or 2Na to S) | | | | Sulfur Retention, % | |
|---|---|---|---|---|---|---|---|---|
| Mix No. | BTU/lb | % S | Silica | Limestone | Dolomite | Nahcolite | Allowed Minimum[a] | Results |
| 5 | 11,730 | 2.152 | 0.0 | | | | 67.3 | |
| 6-A | 11,730 | 2.158 | | | 1.96 | | 67.4 | 74.1 |
| 9-A | 11,730 | 2.243 | | | | 1.25 | 68.6 | 89.7 |
| 12-A | 11,660 | 2.286 | | | 1.86 | | 69.4 | 82.8 |
| 21 | 11,740 | 2.793 | | 2.59 | | | 74.8 | 59.5 |
| 22 | 11,830 | 2.713 | | 2.67 | | | 73.8 | 62.2 |
| 22-A | 11,830 | 2.705 | | | 1.57 | | 73.8 | 70.4 |
| 22-B | 11,830 | 2.713 | | 2.67 | | | 73.8 | 58.5 |
| 23 | 11,740 | 2.769 | | 2.61 | | | 74.6 | 60.2 |
| 24 | 11,840 | 2.666 | | 2.71 | | | 73.4 | 63.3 |

Note:
[a]Calculated for allowed emission of 1.2 lbs $SO_2$/mm BTU.

For the experiments reported herein, the sulfur oxides emitted upon combustion may be calculated on a commonly used basis of total thermal energy input. Table III presents a comparison of the sulfur retentions of 10 petroleum coke mixes with the sulfur emissions allowed from new fossil fuel fired utility steam generator sources. For uses such as home and commercial stove fuel, only mix number five (5) (no sorbent) emitted a slight sulfur dioxide odor.

On the basis of general knowledge, one skilled in the art can assume that dolomite and limestone would be-

EXAMPLE TWO

As depicted in Table IV, raw materials described in Tables IA and IB and Tables IIA and IIB were crushed to minus 50 mesh for pilot side roll briquetting tests. Mixes identical to No. 25 and No. 28 were employed to compare the performance of soft and hard asphaltenes.

TABLE IV

EVALUATION OF BRIQUETTES

| | Wt % Components | | | | Fuel Properties | | | | |
|---|---|---|---|---|---|---|---|---|---|
| | | Asphaltenes | | | | | | Shear[c] | |
| Mix No. | Coke B | Soft | Hard | Dolomite | BTU/lb | % S | Ca/S Ratio | Strength, lbs | S = Retention, % |
| 25-S | 70 | 5 | | 25 | 11,740 | 2.793 | 1.52 | 69 | 77.8[a] |

TABLE IV-continued

| | EVALUATION OF BRIQUETTES | | | | | | | | |
|---|---|---|---|---|---|---|---|---|---|
| | Wt % Components | | | | | | | Shear[c] | |
| | | Asphaltenes | | | Fuel Properties | | Ca/S | Strength, | S = Retention, |
| Mix No. | Coke B | Soft | Hard | Dolomite | BTU/lb | % S | Ratio | lbs | % |
| 28-H | 65 | | 10 | 25 | 11,830 | 2.705 | 1.57 | 74 | 76.9[b] |

Notes:
[a]For allowed emission of 1.2 lbs $SO_2$/mm BTU, required retention = 74.8%
[b]For allowed emission of 1.2 lbs $SO_2$/mm BTU, required retention - 73.8%
[c]Rimac test machine on fresh green briquettes, pillow shaped 1¼" × ¾" × ½" thick.

CONCLUSIONS

The process of the invention can be practiced with other cokes or carbonaceous solids and with binders other than the exemplified asphaltenes as long as they are capable of forming a high compressive strength tumble resistant briquette by cold pressing. The sulfur absorbent mineral to be utilized will depend on the most efficient mineral available at the location of the briquette plant.

It is to be realized that only preferred embodiments of the invention have been described and that numerous substitutions, modifications and alterations are permissible without departing from the spirit and scope of the invention as defined in the following claims:

I claim:

1. A method for forming carbonaceous briquettes which comprises, (a) obtaining carbonaceous material such as from coal, lignite, and or petroleum coke as pulverized fine particle material, (b) dry blending the pulverized carbonaceous material with a finely divided inorganic sulfur scavenger material selected from alkali metals, alkaline earth carbonates, bicarbonates, metal oxides, hydroxides and salts, (c) mixing an asphaltene binder material of deep solvent deasphalting below its softening point and providing a ring and ball softening point in the range of 200° F. to 400° F. with said dry mixture of carbonaceous material and said inorganic sulfur scavenger material, and (e) compressing the mixture thus formed in the absence of external heating to form briquettes of said mixture.

2. The method of claim 1 wherein the dry mixture comprises sulfur sorbent particle material selected from Group 1 and Group 11 alkali metal carbonates or bicarbonates.

3. The method of claim 1 wherein from 5 to 20 wt.% of the asphaltene binder material is employed.

4. The method of claim 1 wherein the asphaltene binder material has a Ring and Ball softening point of 300 to 400 F. and at least 35 wt.% of pentane insoluble asphaltenes.

5. The method of claim 1 wherein the dry mixture is formed at a total moisture content less than 5 percent.

6. The method of claim 1 wherein the product briquette comprises from 50 to 80 wt.% of coke, from 5 to 20 wt.% of asphaltene binder material and from 10 to 30 wt.% of said inorganic scavenger material.

7. The method of claim 1 wherein the asphaltene binder material is hard asphaltene material comprising from 35 to 80 wt.% of pentane insoluble asphaltenes and a carbon to hydrogen ratio of at least 0.8.

8. The method of claim 1 wherein the finely divided inorganic scavenger material is either dolomite, trona, limestone or nahcolite.

9. The method of claim 1 wherein the compressed briquette comprise from 5 to 10 wt.% of hard asphaltenes having a softening point of at least 300 F.

10. The method of claim 1 in which the formed briquettes dimensions are within the range of ⅜ inch to 3 inches.

11. The method of claim 1 wherein the asphaltene binder material is the residue resulting from butane and/or pentane extraction of petroleum.

* * * * *